US005277341A

United States Patent [19]

Privas

[11] Patent Number: 5,277,341

[45] Date of Patent: Jan. 11, 1994

[54] DEVICE FOR SPRAYING A FLUID BY MEANS OF A PUMP THAT IS ACTUATED REPEATEDLY BY A SOLENOID

[75] Inventor: Yves Privas, Pompano Beach, Fla.

[73] Assignee: Conceptair Anstalt, Liechtenstein

[21] Appl. No.: 826,519

[22] Filed: Jan. 27, 1992

[30] Foreign Application Priority Data

Jan. 29, 1991 [FR] France ..... 91 00958

[51] Int. Cl.[5] ..... B65D 83/00; B05B 11/00; B05B 11/02

[52] U.S. Cl. ..... 222/333; 222/321; 239/332; 417/416

[58] Field of Search ..... 222/333, 504, 385, 383; 239/332; 417/415–418

[56] References Cited

U.S. PATENT DOCUMENTS

| | | | |
|---|---|---|---|
| 3,243,013 | 3/1966 | Molin et al. | 222/333 |
| 3,253,742 | 5/1966 | Sanders et al. | 222/333 X |
| 3,352,497 | 11/1967 | Abramson | 239/332 X |
| 3,437,043 | 4/1969 | Sanders et al. | 417/416 |
| 3,521,794 | 7/1970 | Bijl | 222/333 X |
| 3,680,789 | 8/1972 | Wagner | 239/332 |
| 4,160,525 | 7/1979 | Wagner | 222/333 X |
| 4,162,037 | 7/1979 | Koyama | 222/333 X |
| 4,189,098 | 2/1980 | Wagner et al. | 239/332 X |
| 4,238,055 | 12/1980 | Staar | 239/332 X |
| 4,967,935 | 11/1990 | Celest | 222/333 X |
| 5,014,884 | 5/1991 | Wunsch | 222/333 |
| 5,058,780 | 10/1991 | Plester et al. | 222/333 X |
| 5,062,547 | 11/1991 | Zähner et al. | 222/333 X |
| 5,221,025 | 6/1993 | Privas | 222/333 X |

FOREIGN PATENT DOCUMENTS

| | | | |
|---|---|---|---|
| 401060 | 4/1990 | European Pat. Off. . | |
| 0448467 | 3/1991 | European Pat. Off. . | |
| 197806 | 6/1978 | Fed. Rep. of Germany | 239/332 |
| 2645661 | 6/1978 | Fed. Rep. of Germany . | |
| 2736532 | 11/1978 | Fed. Rep. of Germany . | |
| 3836291 | 3/1990 | Fed. Rep. of Germany | 239/332 |
| 797946 | 5/1936 | France . | |
| 2314772 | 1/1977 | France . | |
| 959835 | 6/1964 | United Kingdom . | |

*Primary Examiner*—Andres Kashnikow
*Assistant Examiner*—Kenneth DeRosa
*Attorney, Agent, or Firm*—Sughrue, Mion, Zinn, Macpeak & Seas

[57] ABSTRACT

A device for spraying or dispensing a fluid, the device comprising: a single-acting pump having a capacity of less than 500 μl and provided with piston means actuated by a hollow push rod allowing fluid to flow therealong, said piston means sliding in a pump chamber that normally contains fluid to be sprayed or dispensed, to enable said fluid to be expelled; a pusher mounted on said push rod of the pump and communicating with said push rod to enable the fluid to escape; and rapid repetition actuator means having a moving portion for actuating the push rod repetitively; wherein the pusher is connected to said moving portion of the actuator means by a connection that does not leave play in the axial direction of the push rod.

27 Claims, 13 Drawing Sheets

FIG.6
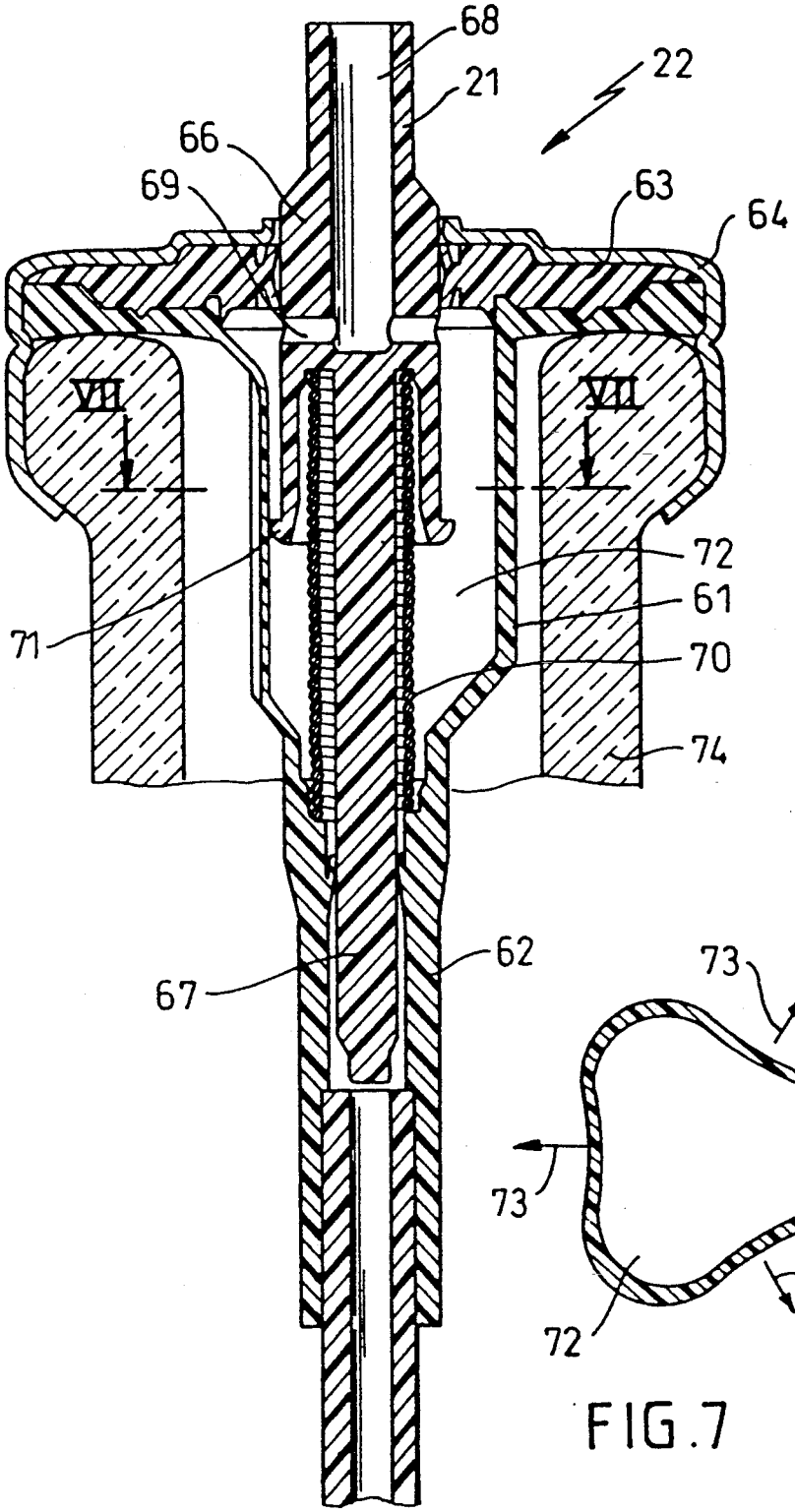
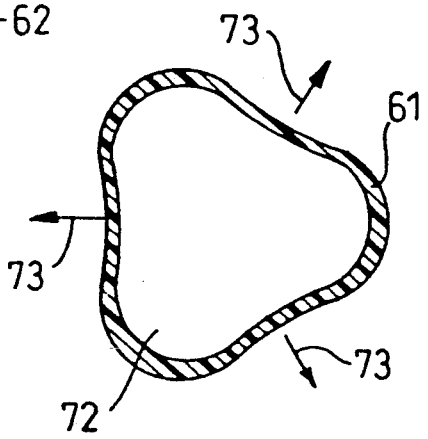
FIG.7

FIG. 16
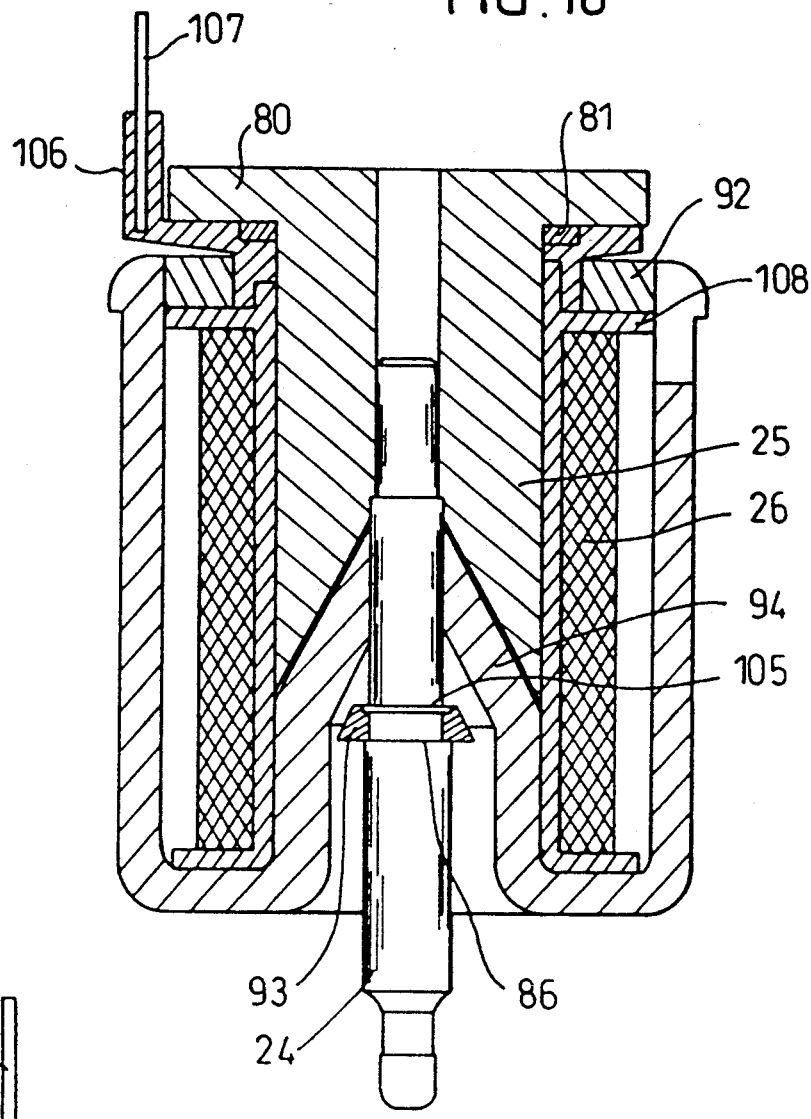
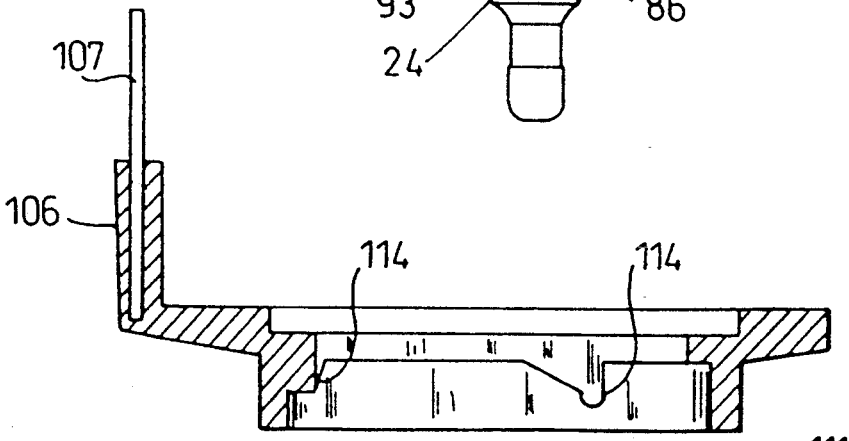
FIG. 17
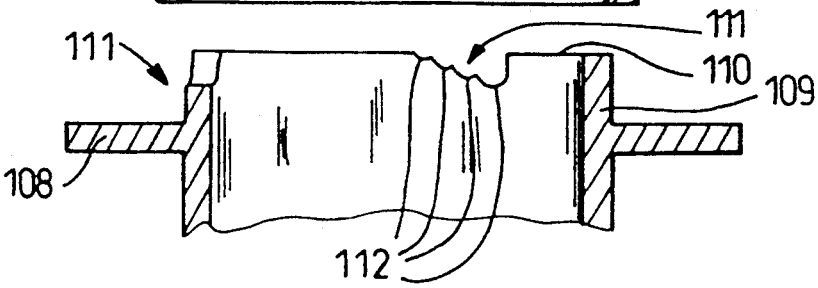
FIG. 18

DEVICE FOR SPRAYING A FLUID BY MEANS OF A PUMP THAT IS ACTUATED REPEATEDLY BY A SOLENOID

The present invention relates to dispensing, spraying, and vaporizing system enabling a fluid such as a liquid or a cream to be projected in the form of very fine droplets, or enabling said fluid to be dispensed without spraying in a manner that is continuous or nearly continuous.

BACKGROUND OF THE INVENTION

Until the fairly recent past it was common practice to use devices known as "aerosol cans" containing a propellant gas of the freon type (chlorofluorocarbon). The use of that propellant is objectionable to ecologists and attempts are being made to do without it. The only replacement propellant gases that have appropriate characteristics are hydrocarbons and these turn out to be dangerous for users.

Proposals have been made in European patent application EP 0 401 060 to use systems that do not include any propellant gas, and that make use of a single-acting pump with a return spring that is generally of the hand operated type and that is actuated rapidly and repeatedly by mechanical means, e.g. 50 or more times a second, thereby obtaining a spray that is projected in a manner that gives the appearance of being the same as when a propellant gas is used. The pump chamber is filled by suction during the return stroke under the action of the return spring. An example of a suitable pump is described in French patents Nos. FR 2 305 241 and FR 2 314 772, and also in U.S. Pat. No. 4,025,046. Another example of a suitable pump is described in European patent application EP 0 330 530 and in U.S. Pat. No. 4,936,492. Those pumps have the advantage of being very cheap since they are generally made of molded plastic and they are mass-produced in the packaging industry for perfumes, cosmetics, and pharmaceuticals.

The pumps used in those applications have pump chambers with a capacity that usually lies in the range of 40 microliters (μl) to 300 μl, and more generally in the range 10 μl to 500 μ. Such a pump is mounted by screwing, crimping, or the like onto the neck of a receptacle such as a flask, and it is actuated by a tubular rod that projects vertically and axially from the center thereof. A pusher is mounted on the rod and may include an appropriate spray nozzle depending on the application, with the pusher including an internal channel putting the actuator rod into communication with the nozzle. The pusher serves both to enable thrust to be applied to the pump for emptying its chamber, and to allow the fluid to escape. In addition, if it includes a nozzle, the pusher must hold the nozzle in a manner suitable for spraying. In devices of the kind concerned by the present invention, where the pump and thus the pusher needs to be actuated in rapid repetition, the nozzle or outlet in the pusher is not generally situated on the axis of the pump since it is necessary to apply considerable thrust frequently on the pusher by mechanical or electromechanical means and it is preferable for that to be done on the axis of the pump actuator rod. In general, the pusher is perpendicular to the axis of the pump. The pusher actuator means may advantageously be an electromagnetic device including a fixed winding such as a solenoid and a moving core or plunger which bears against the pusher to actuate the pump when the solenoid is excited. Reciprocating motion can be imparted to the core by rotary means fitted with a crank, a cam, an eccentric, or equivalent means, with or without the use of a return spring. During the downwards motion when the piston compresses the fluid in the chamber in order to expel it, the core moved with the pusher by exerting a driving force thereon against the return spring, after which the core returns under the effect of its own return means while the pusher rises independently under the effect of the return spring of the pump.

The inventor has observed that devices of the kind described above are noisy, subject to vibration, and subject to unwanted variations in the flow rate of the sprayed fluid. These drawbacks are a severe handicap for devices intended for the consumer market, particularly since such devices are in competition with devices that make use of a propellant gas and that are free from such drawbacks.

An object of the present invention is therefore to resolve this technical problem.

The inventor has observed that the problem is related to a lack of synchronization between the pusher and the core due to the possibility of them having different return speeds. Because of this lack of synchronization, the core strikes the pusher while it is still rising, thus giving rise to a more violent shock that generates noise and vibration, and also causing an incomplete quantity of fluid to be expelled since the piston of the pump has not had the time to rise all the way to its rest position for sucking a full dose of fluid into the chamber. In addition, because of the violence of the shock between the core and the pusher, the core may bounce off the pusher, thereby accentuating problems of noise and vibration and also accentuating the phenomenon of loss of synchronization.

SUMMARY OF THE INVENTION

The present invention provides a device for spraying or dispensing a fluid, the device comprising:

a single-acting pump having a capacity of less than 500 μl and provided with piston means actuated by a hollow push rod allowing fluid to flow therealong, said piston means sliding in a pump chamber that normally contains fluid to be sprayed or dispensed, to enable said fluid to be expelled;

a pusher mounted on said push rod of the pump and communicating with said push rod to enable the fluid to escape; and rapid repetition actuator means having a moving portion for actuating the push rod repetitively;

wherein the pusher is connected to said moving portion of the actuator means by a connection that down not leave play in the axial direction of the push rod.

The pusher and the actuator means may be connected together by a hinge, advantageously a ball-and-socket type hinge, thereby making it possible to accommodate play in the alignment between the actuator means and the pusher, or to accommodate deformation in the parts. The pusher is generally made of plastic while the portion of the actuator means that is connected to said pusher may be made of metal, thereby obtaining a good coefficient of friction.

The invention also provides a device for spraying or dispensing a fluid, the device comprising:

a single-acting pump having a capacity of less than 500 μl and provided with piston means actuated by a hollow push rod allowing fluid to flow therealong, said piston means sliding in a pump chamber that normally contains fluid to be sprayed or dispensed, to enable said fluid to be expelled;

a pusher mounted on said push rod of the pump and communicating with said push rod to enable the fluid to escape; and rapid repetition actuator means having a moving portion for actuating the push rod repetitively;

wherein the push rod is connected to said moving portion of the actuator means by a connection that does not have any play in the axial direction of the push rod. In this embodiment of the invention, the pusher may optionally be omitted.

In another embodiment of the invention, the actuator means comprises a core actuated by a solenoid, said core being extended towards the pump pusher by an actuator rod that is connected both to the core and to the pusher.

Advantageously, the pump includes resilient return means for the piston means and said resilient means also serves to return the actuator means.

In a variant of the invention, the device includes retention means preventing the pusher form coming apart from the push rod. The said retention means may be resilient arms disposed on either side of the pusher, each including one end that is secured to the pump and a free end provided with a catch that limits the motion of the pusher in a direction going away from the pump. Said retention means may be means for securing the pusher on the pusher rod, and advantageously they may be snap-fastening means. In a particularly advantageous embodiment of the invention, the pump down not include resilient return means for the piston means, and the actuator means includes resilient return means that also serves to return the pump means of the piston. It is thus possible to avoid having a spring in the pump chamber, thereby avoiding any contact between a metal and the fluid to be sprayed or dispensed. The said actuator means may include abutment means for limiting the stroke of its moving parts when they move away from the pump.

The said actuator means may also include end-of-stroke abutment means for limiting the stroke of its moving parts in an end-of-stroke position, said abutment means optionally being adjustable.

In another embodiment, the device includes a core actuated by a solenoid, and the pump includes an inlet valve which closes by relative displacement of two portions that slide on within the other, one of said portions being displaceable with the piston means, and the inlet valve closing only after the piston means has performed a certain amount of lost motion.

In another embodiment, the device includes a core actuated by a solenoid, that the core includes an outwardly directed flange and slides in a coaxial ring which is adjustable in position, said ring having an inwardly directed flange which limits the stroke of the flange of the core towards the pump, said ring also having an inwardly directed rim situated on the side of the core flange facing away from the pump and the ring contains a flexible shock absorbing sleeve having a first end held against the inwardly extending rim of the ring and a second end fixed to the flange of the core. Advantageously, said second end of the flexible sleeve includes an inwardly directed rib disposed between the flange of the core and the inwardly directed flange of the ring.

In a particular embodiment of the pusher of the invention, the pusher includes a spray nozzle engaged in a cavity thereof, said nozzle forming two cylinders of different diameters, each provided with fastening means corresponding with fastening means on the facing surfaces of the cavity in the pusher, e.g. screw threads or catches.

In addition, the nozzle may be constituted by two different-diameter portions engaged one inside the other, an outer portion projecting from the pusher and an inner portion engaged in the end of the cavity in the pusher so that pressure between the two portions of the pusher urges the inside portion towards the end of the cavity in the pusher.

In a particular embodiment of the invention, the pump operates without drawing in air, and includes a deformable tank having a top portion in which an opening for receiving the pump is formed, the tank including at least one deformable wall, said deformable wall being adapted to move between a first position in which the tank defines a maximum inside volume, and a second position in which the tank defines a substantially zero inside volume, and it further includes resilient means urging said deformable wall towards its second position with sufficient force to establish a pressure in the vicinity of the pump which is greater than the vaporization pressure of said fluid at ambient temperature, regardless of the position of said deformable wall. Said pressure may be at least equal to atmospheric pressure, or it may be at least 20 kPa greater than atmospheric pressure. In a particular example of this embodiment, the deformable wall includes a rigid bottom and a flexible side wall, said resilient means urging the rigid bottom towards the pump, and as the volume of fluid contained in the tank decreases, the bottom of the deformable wall moves towards the pump folding said flexible side wall progressively over itself. The deformable tank may be placed in a rigid sheath that is substantially complementary in shape to the side wall of said tank.

BRIEF DESCRIPTION OF THE DRAWINGS

Embodiments of the invention are described by way of example with reference to the accompanying drawings, in which:

FIG. 6 is a longitudinal section view of another pump usable in the device of the present invention;

FIG. 7 is a cross-section through the pump of FIG. 6 on line VII—VII of FIG. 6;

FIG. 16 is a section view similar to FIG. 11 for an embodiment of the invention that includes adjustment for the stroke of the core;

FIGS. 17 and 18 are views showing details of FIG. 16; and

In the various drawings, the same references designate items that are the same or that are similar.

DETAILED DESCRIPTION

Figure 1:
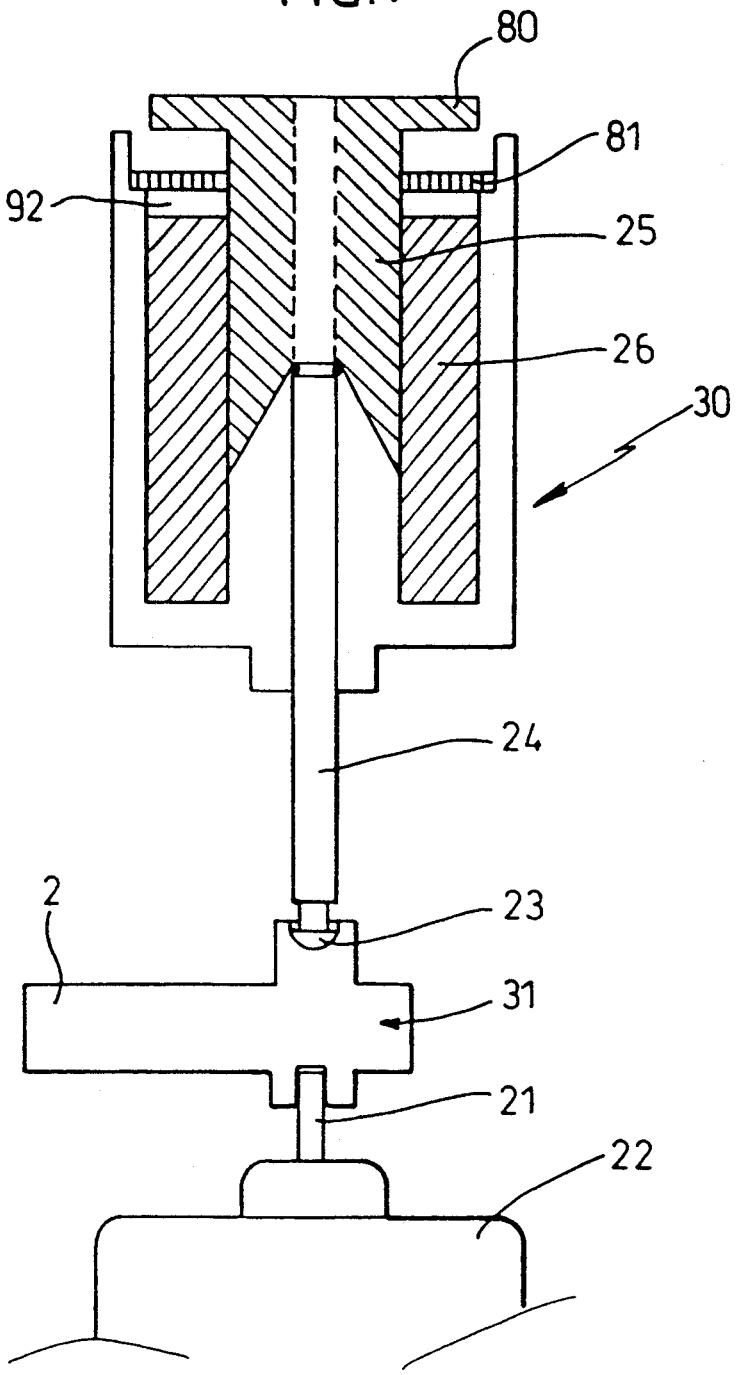
FIG. 1 is a diagrammatic overall view of a first embodiment of the device of the present invention, showing a pusher connected to the core of a solenoid for actuating a spray pump.

FIG. 1 shows a first embodiment of the device of the invention which comprises a tank (not shown) of fluid to be sprayed or dispensed, and which has a pump 22 mounted thereon. Conventionally, the pump 22 comprises a sliding hollow push rod 21 which serves both to actuate the pump 22 and to provide the outlet for the pumped fluid. A pusher 31 is mounted on the push rod 21 merely by being fitted thereon, or by any other suitable means: the pusher 31 includes a lateral nozzle 2 in communication with the actuator rod 21 and enabling the fluid to escape. The device further includes rapidly repeating actuator means 30 constituted in this case by a solenoid 26 and a core 25 made of magnetic material such as soft iron. The actuator means 30 is centered on the push rod 21 and is connected to the pusher 31 by an actuator rod 24 which is preferably made of a non-magnetic material, e.g. bronze or stainless steel, and it is in alignment with the pusher 21 of the pump while being secured to the core 25. The actuator means 30 is not described in detail herein, further details may be obtained by referring to European patent application EP 0 401 060, and it shown be understood that the present invention is not limited to the particular embodiments described in that patent application.

The pump 22 may be any type of piston pump as is commonly used in perfume sprays, pharmaceutical sprays, or cosmetic sprays, and in general it includes a piston return spring. During testing, the present inventor has observed that at least two types of pump operate particularly well in the device of the invention: 1) pumps of the type described in French patents Nos. FR 2 305 241 and FR 2 314 772 and in U.S. Pat. No. 4,025,046; and 2) pumps of the type described in European patent No. EP 0 330 530 and in U.S. Pat. No. 4,936,492.

Figure 5:
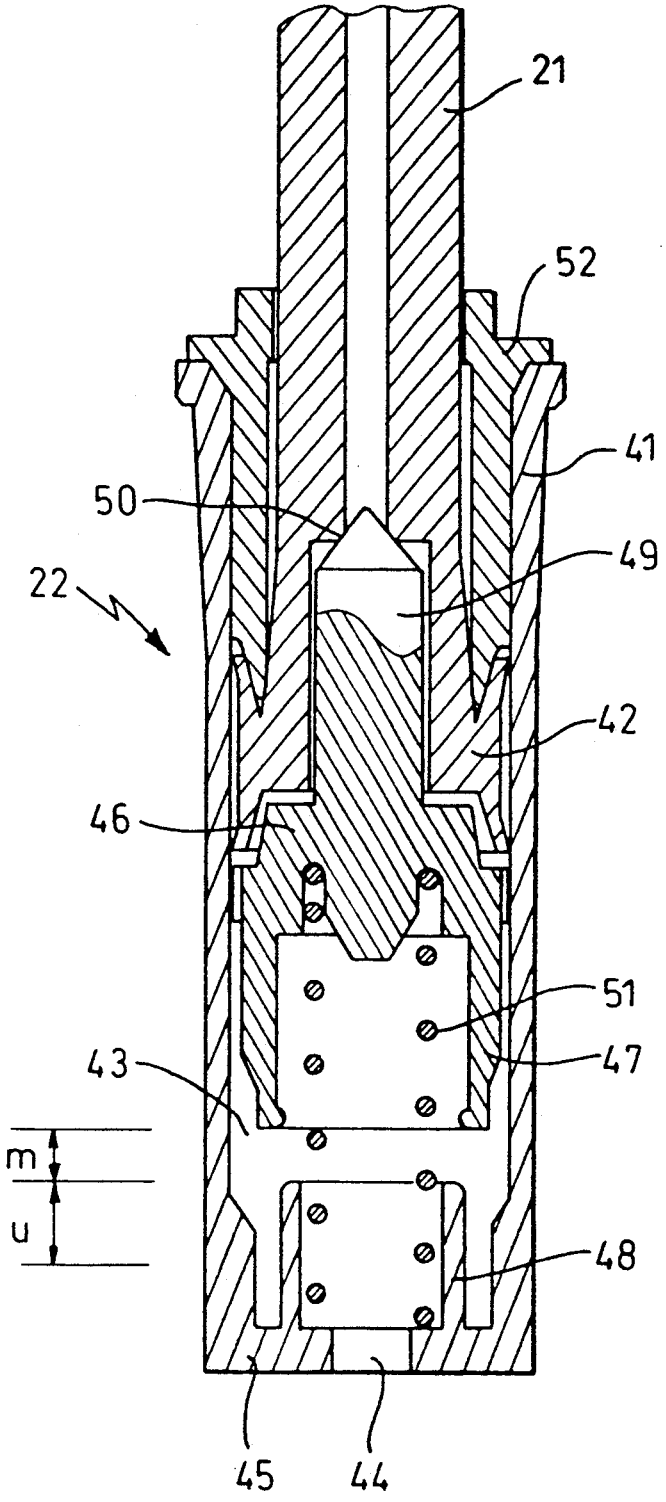
FIG. 5 is a longitudinal section through a pump that is usable in the device of the present invention.

FIG. 5 shows an example of a pump of above-defined type 1. The pump 22 may be made of molded plastic, and it comprises a hollow cylindrical pump body 41 having a hollow piston 42 slidably received therein, the piston 42 likewise being hollow and extending outside the pump by means of above-described hollow push rod 21. The pump body 1 includes an open end having the hollow rod 21 passing therethrough, and an end which is closed by a bottom 45. The bottom 45 is pierced by a suction orifice 44 which communicates with the tank of fluid (not shown). The orifice 44 may optionally be provided with a dip tube. The pump 22 further includes a valve member 46 provided with a skirt 47 that fits in fluid-tight manner over a tubular endpiece 48 that is formed around the suction orifice 44, and that is also provided with a punch 49 adapted to bear in fluid-tight manner against a valve seat 50 formed inside the piston 42. A return spring 51 is disposed between the valve member 46 and the bottom 45, and it urges the punch against the valve seat 50, thereby urging the piston 42 towards the open end of the pump body 41. A sleeve 52 is fixed in said open end of the pump body to serve as an abutment for the piston 42, thereby defining a rest position for the piston 42. When the push rod 21 is actuated, after a certain amount of lost motion m, the skirt 47 fits over the endpiece 48, thereby isolating a pump chamber 43 delimited by the pump body 41 and the piston 42. The pressure in the incompressible fluid contained in the pump chamber 43 then increases until it is sufficient to lift the punch 49 off its seat 50 against the force of the spring 51. The fluid is then expelled via the rod 21, and the piston 42 moves down inside the pump chamber through a working stroke u. As soon as the downwards motion of the piston comes to an end, the punch 49 is pressed back against the seat 50 by the spring 51, thereby isolating the pump chamber again. When thrust ceases to be applied to the push rod 21, the spring 51 returns the piston 42 and the rod 21 towards their rest position, thereby setting up suction in the pump chamber 43: at the end of this motion, the skirt 47 disengages from the endpiece 48 and a new quantity of fluid is sucked into the pump chamber 43. The skirt 47 thus acts as an inlet valve, whereas the punch 49 acts as an outlet valve.

FIGS. 6 and 7 show an example of a pump of above-described type 2 in its actuated position. The pump 22 in FIGS. 6 and 7 is generally made by molding synthetic materials, and it comprises a hollow pump body 61 defining a pump chamber 72 of non-circular section, which chamber is made of an elastomer material and is elastically deformable in a radial direction. The pump body 61 extends between an open end which is partially closed by a circular washer 63 held in place by a crimped metal cap 64, and a narrow end 62 which is in communication with a tank 74 of fluid. The pump 22 also includes a push rod 21. The push rod 21 has an enlarged portion 66 which slides in fluid-tight manner through the washer 63, thereby acting as a piston, and it extends towards the narrow end 62 of the pump body in the form of a small-section rod 67 that fits in fluid-tight manner in said narrow end 62 of the pump body when the push rod 21 is actuated. The push rod 21 also includes an axial outlet channel 68 which opens out sideways via at least one orifice 69 formed through its enlarged portion 66. Finally, a return spring 70 urges the push rod 21 outwards, while the said push rod includes an outwardly directed shoulder 71 at the bottom of its enlarged portion 66 for coming into abutment against the washer 63 when the push rod is in a rest position.

When the pump 22 is in its rest position, the narrow rod 67 is disengaged from the narrow end 62 of the pump body, and the outlet orifice 69 is separated from the pump chamber by the washer 63 (in FIG. 6, the orifice 69 would be above the washer 63). When the push rod 21 is pushed into the pump body 61, after a certain amount of lost motion, the rod 67 engages initially in the narrow end 62, thereby isolating the pump chamber 72, and further downwards motion of the rod 65 causes the pressure in the fluid contained in the pump chamber 72 to increase because the enlarged portion 66 acts as a piston. This increase in pressure gives rise to resilient radial deformation of the pump body 61 in the direction of arrows 73 (see FIG. 7). When the rod 65 has been pushed down far enough for its orifice 69 to penetrate into the pump chamber, as shown in FIG. 6, the fluid begins to be expelled via the orifice 69 as the pump body 61 returns to its initial shape. When the push rod 21 is released, it rises under drive from the return spring 70. The orifice 69 initially leaves the pump chamber 72, thereby isolating the chamber, after which the upwards motion of the push rod establishes suction in the pump chamber 72, and finally the narrow rod 67 moves out from the narrow end 62, thereby allowing a quantity of fluid to be sucked into the pump chamber 72. The narrow rod 67 thus acts as an inlet valve while the enlarged portion 66 of the push rod serves both as a piston and as an outlet valve.

The two pumps described by way of example above are not limiting, and serve merely to facilitate understanding how a pump can be used in the context of the present invention. In any event, such a pump includes a hollow body defining a pump chamber, piston means actuated by a push rod and capable of compressing the pump chamber, said piston being displaceable between a "top dead center" or rest position and a "bottom dean center" or end-of-stroke position, inlet valve means, and outlet valve means serving respectively to allow fluid to enter the pump chamber only and to allow fluid to leave the pump chamber only. In conventional applications where such pumps are actuated by hand, they include resilient means for returning the piston. However, in the invention, the pump may be actuated by means that impart reciprocating motion to the push rod of the piston, in which case the resilient return means for the piston can be omitted in many type of pump, e.g. the pump shown in FIGS. 6 and 7. This is particularly advantageous insofar as it is then possible to avoid said resilient means (generally a metal spring) coming into contact with the fluid in the pump chamber, thus avoiding polluting the fluid by oxidizing the spring or by leeching any heavy metals that may be included in the composition of the spring. Nevertheless, it should be observed that such resilient return means can be omitted only in pumps where the sole function of said resilient means is to apply thrust to the piston means. For example, the pump of FIG. 5 cannot operate without its own return spring since the spring also serves to close the outlet valve and to open the inlet valve during the up stroke of the piston.

In the embodiment shown in FIG. 1, the pump 22 used in the device of the invention must have its own resilient means for returning the piston, as explained below.

Figure 2:
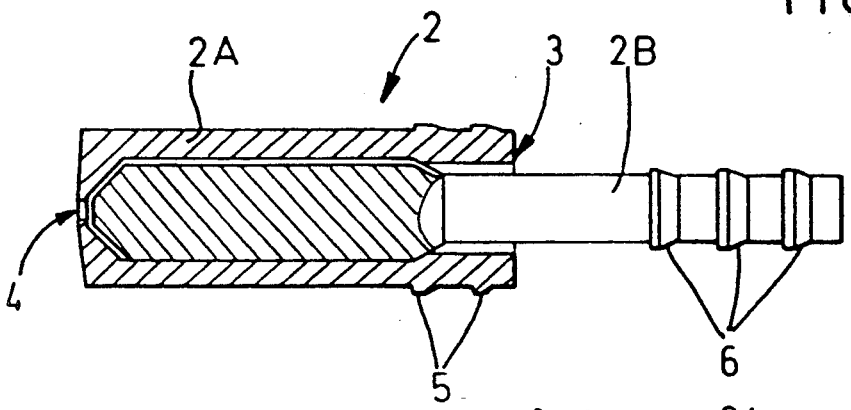
FIG. 2 is an elevation view in partial section of a spray nozzle in accordance with the present invention.
Figure 3:
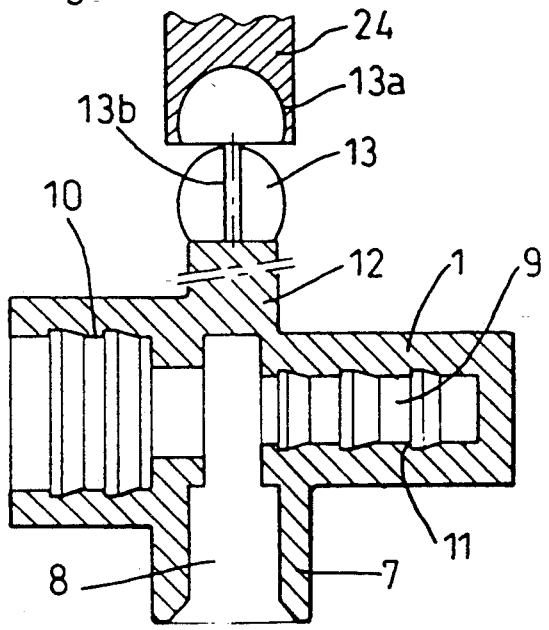
FIG. 3 is a section view through one embodiment of a pusher body of the invention suitable for use with a spray pump.
Figure 4:
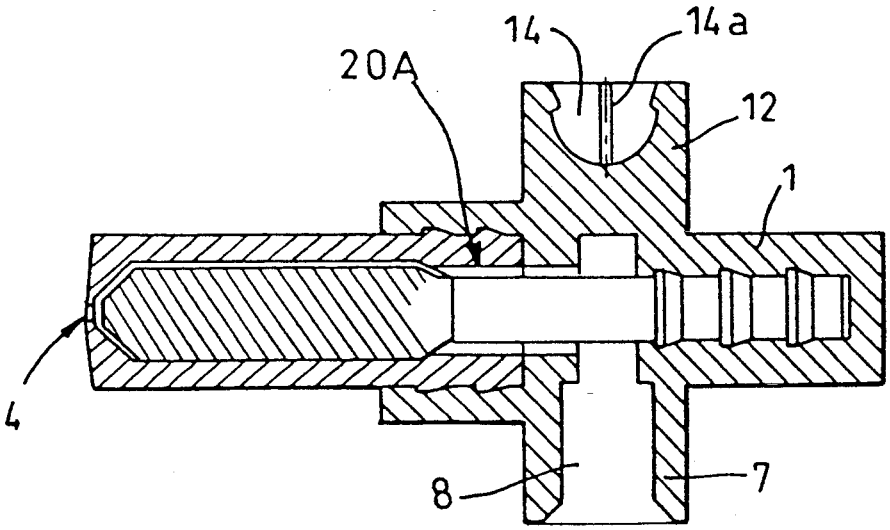
FIG. 4 is a view similar to FIG. 3 but shows a variant embodiment provided with a spray nozzle as shown in FIG. 2.

FIGS. 2 to 4 show a particular embodiment of the pusher 31 of the invention.

The pusher 31 comprises a head or body 1 with an elongate nozzle 2 that acts as a spray nozzle and that extends between two portions 2A and 2B comprising an outer portion of endpiece and an inner portion, both of which are elongate in shape. The inner portion is engaged over a certain length within a cavity formed in the endpiece via an opening 3 to said cavity, which opening is formed at one of the ends of the outer portion. The spray outlet is constituted by an orifice 4 in the endpiece at its end distant from the opening 3. The walls of the cavity and/or the walls of the inside portion engaged in the cavity include relief such as ribs, grooves, or flats so as to constitute passages between the spray orifice 4 and the inlet 3 to the cavity. The endpiece includes catches 5 and the inside portion includes catches 6, thereby enabling the spray nozzle to be secured in a suitable cavity in the pusher. The inside portion is forced into the endpiece so as to get past a portion 20A of smaller diameter. The two portions may optionally subsequently by fixed to each other, e.g. by ultrasonic welding.

The pusher 1 has a vertical cylindrical skirt 7 for fixing purposes extending downwards and designed to engage on the actuator rod of the pump 22 (FIG. 1). The inside 8 of the skirt communicates with a horizontal cavity 9 of elongate shape provided for receiving the spray nozzle in such a manner as to provide a fluid flow path from the push rod 21 of the pump to the spray nozzle. This cavity is formed with two different diameters corresponding to the two diameters of the spray nozzle. These two portions are provided with catches 10 and 11 corresponding to the catches 5 and 6 of the spray nozzle. As can be seen in FIG. 3, when the pressure of the liquid inside the spray nozzle increases, then the inside portion of the spray nozzle is urged towards the end of the cavity 9, thereby opposing any expulsion of the spray nozzle from the cavity.

FIG. 4 shows the assembled pusher 31. Although the above-described pusher is advantageously suitable for implementing the present invention, the invention can be applied to other types of pusher and spray nozzle. In particular, if it is desired to dispense the fluid without spraying it, the pusher 31 need not include a spray nozzle, but merely a nozzle 2 having an outlet section that is large enough.

Snap-fastening the endpiece 2A and the inside portion 2B into the body 1 makes it possible to provide a pusher that can withstand high pressures, in the order of 100 bars or more, as may be generated when the device is actuated very rapidly.

In accordance with the invention, the pusher is provided (preferably on the axis of the skirt 7, i.e. on the axis of the pump control rod) with fastening means of the ball-and-socket type for engaging the bottom end of the actuator rod 24 which is connected to the core 25 of the actuator means 30. This type of pusher makes it possible using a common body 1 to install different nozzles and spray nozzles, in particular nozzles of different lengths adapted to various fluids that are to be expelled: hair spray, perfume, etc.

In FIG. 3, the pusher is provided with a projection 12 including a ball 13 that may include at least one slot **13*b* to impart a degree of flexibility thereto, in particular for enabling it to be engaged in a socket 13*a* at the end of the actuator rod 24, thereby snap-fastening the two parts together. The slot 13*b*** could optionally be replaced by grooves.

In FIG. 4 and in FIG. 1, the projection 12 includes a socket 14 for receiving a ball 23 at the end of the actuator rod 24. The wall of the socket 14 may include grooves or slots 14*a* to make it flexible and to facilitate snap-fastening onto the end 23, and also to facilitate relative motion between the ball 23 and the socket 14.

All three parts 1, 2A, and 2B constituting the pusher 31 as shown in FIGS. 2 to 4 may be made by injection molding.

The materials used for making these three parts 1, 2A, and 2B, may, for example, by polypropylene or polyethylene terephthalate for the head and polybutylene terephthlate or an acetal resin for the endpiece 2A and the inside 2B of the spray nozzle, thus suitable for sterilization, even by radiation.

The FIG. 1 device operates as follows. When the solenoid 26 is activated, the core 25 is moved suddenly towards the pump 22, bearing against the push rod 21 of the pump via the actuator rod 24 and the pusher 31. The piston means of the pump 22 is thus actuated, thereby causing a quantity of fluid to be ejected via the nozzle 2 of the pusher. The motion continues until an abutment position which is referred herein as "bottom dead center". Advantageously, the bottom dead center position is defined by a flange 80 formed on the outside of the core 25 at its end which is distant from the pump 22, said flange 80 optionally coming into abutment against a washer 81 of shock absorbing material to prevent the core 25 vibrating and rebounding. A metal washer 92 is generally interposed between the solenoid and the washer 81 in order to improve the efficiency of the solenoid.

As soon as the solenoid 26 ceases to be activated, the resilient return means of the piston means in the pump 22 urges the piston means of the pump 22 back to its rest position, thereby pushing back the push rod 21, the pusher 31, the rod 24, and the core 25 to their initial positions.

Because of the connection between the rod 24 and the pusher 31, the motion of the pump 22 is accurately synchronized with the motion of the core 25, thereby eliminating noise, vibration, and inaccuracy in measuring out fluid due to lack of synchronization. In addition, this connection eliminates core rebounds and it reduces vibration that is not due to lack of synchronization. The actuator means 30 can therefore operate at a very high rate, e.g. 1 to 50 go-and-return cycles per second, or more.

In particular, using a connection by means of a ball-and-socket facilitates assembly particularly since the device can be snap-fastened together, and it also serves to compensate for defects in alignment, and also to absorb possible deformation, e.g. due to vibration of the pusher.

The device of the invention may be contained in a housing 100 (see FIG. 11) suitable for holding in the head, for example, and including a cap that reinforces the actuator means 30 and the rod 24. The device may be assembled by snap-fastening the tank fitted with the pump 22 to the pusher 31 on the cap of the housing. Advantageously, the rod 24 is simultaneously snapped onto the pusher 31 while snap-fastening to the tank.

The device of FIG. 1 is also advantageous in that it does not require a return spring for the core 25, thereby reducing cost. However, a return spring may be provided for the core 25 without going beyond the scope of the present invention.

Figure 8A:
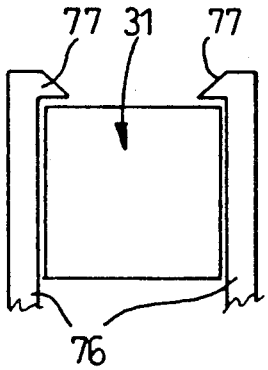
FIG. 8*a* is an elevation view showing a detail of FIG. 8 in the direction of arrow A.
Figure 8:
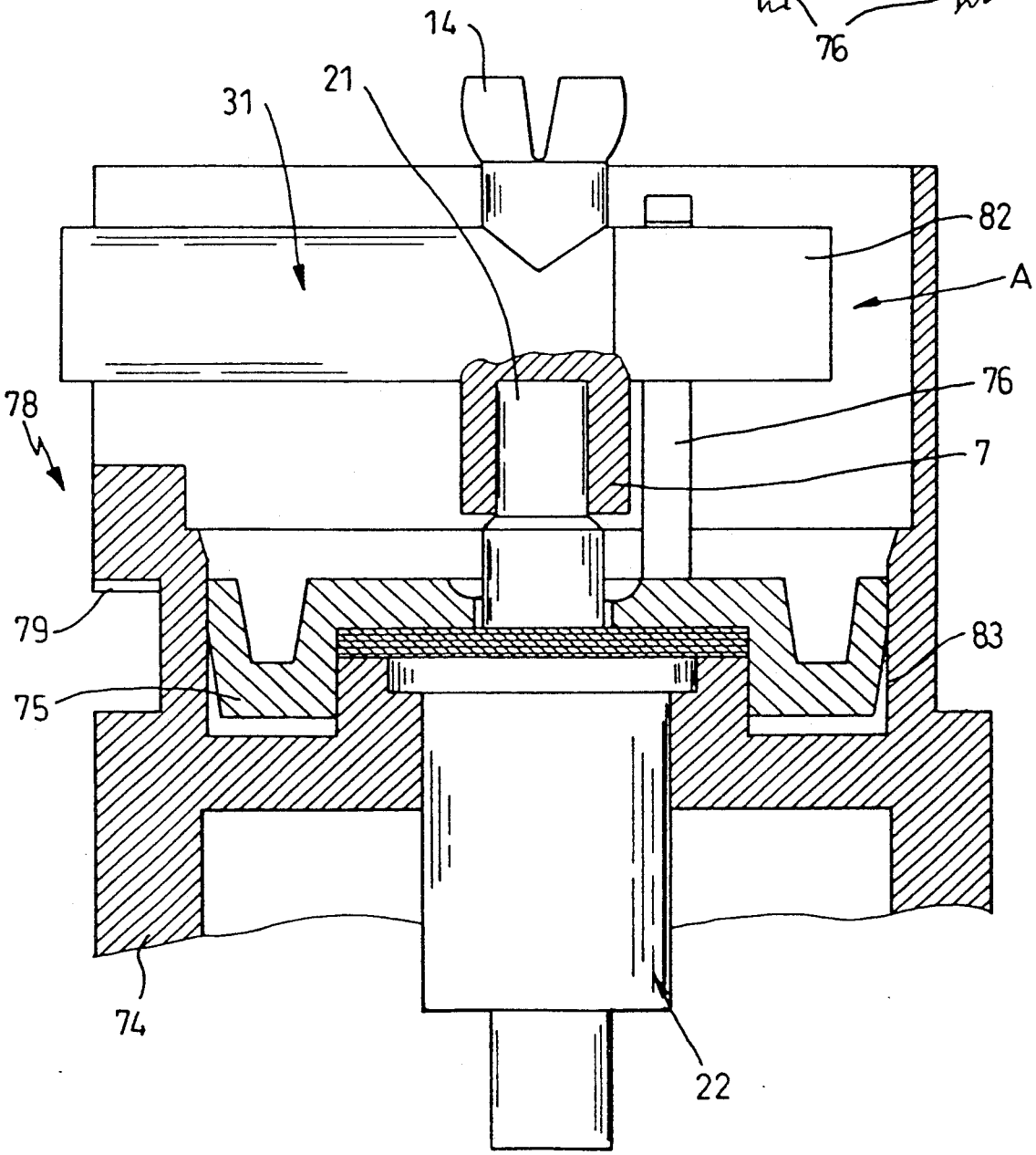
FIG. 8 is a fragmentary section view through a pump and a pusher mounted on a tank constituting a variant of the invention.

FIGS. 8 and 8*a* show a variant of the FIG. 1 device in which the tank of fluid 74 includes a special neck 78 that may be integrally formed with the tank or that is fixed thereon, e.g. by screwing. The neck 78 is adapted to be fixed in a housing 100 (see FIG. 11) which contains the actuator means 30 and the actuator rod 24. The fixing may be provided, for example, by engaging in a recess in the housing which is complementary in shape to the neck 78, and by locking the neck 78 by rotation, thereby causing a projection 79 on the neck to snap into a complementary shape of the housing. When the neck 78 is engaged in the housing, the pusher 31 couples to the actuator rod 24 by snap-fastening.

When the tank 74 is empty, the assembly constituted by the pump 22, the tank 74, and the pusher 31 is replaced. In order to prevent the pusher 31 from disengaging the push rod 21 of the pump 22 during such replacement, two pusher-retaining arms 76 are provided that are secured to the tank 74 and to the pump 22. For example, the pusher 31 may have a rear portion 82 that is rectangular in section, and the arms 76 may both be resilient arms extending parallel to the push rod 21 from an end that is secured to the tank 74 and to the pump 22, and an end provided with a catch 77 suitable for retaining the pusher 31 between the two arms 76 by limiting the motion available to the pusher in a direction away from the pump 22. The arms therefore do not interfere with the reciprocating displacement of the pusher 31 during actuation of the pump 22.

The neck 78 may include a central basin 83 adapted to receive a capsule 75 of plastic material, e.g. a force-fit in the basin 83, for fixing the pump 22. In which case it is advantageous for the arms 76 to be secured to the capsule 76, for example the arms 76 may be integrally molded with the capsule 75.

Figure 9:
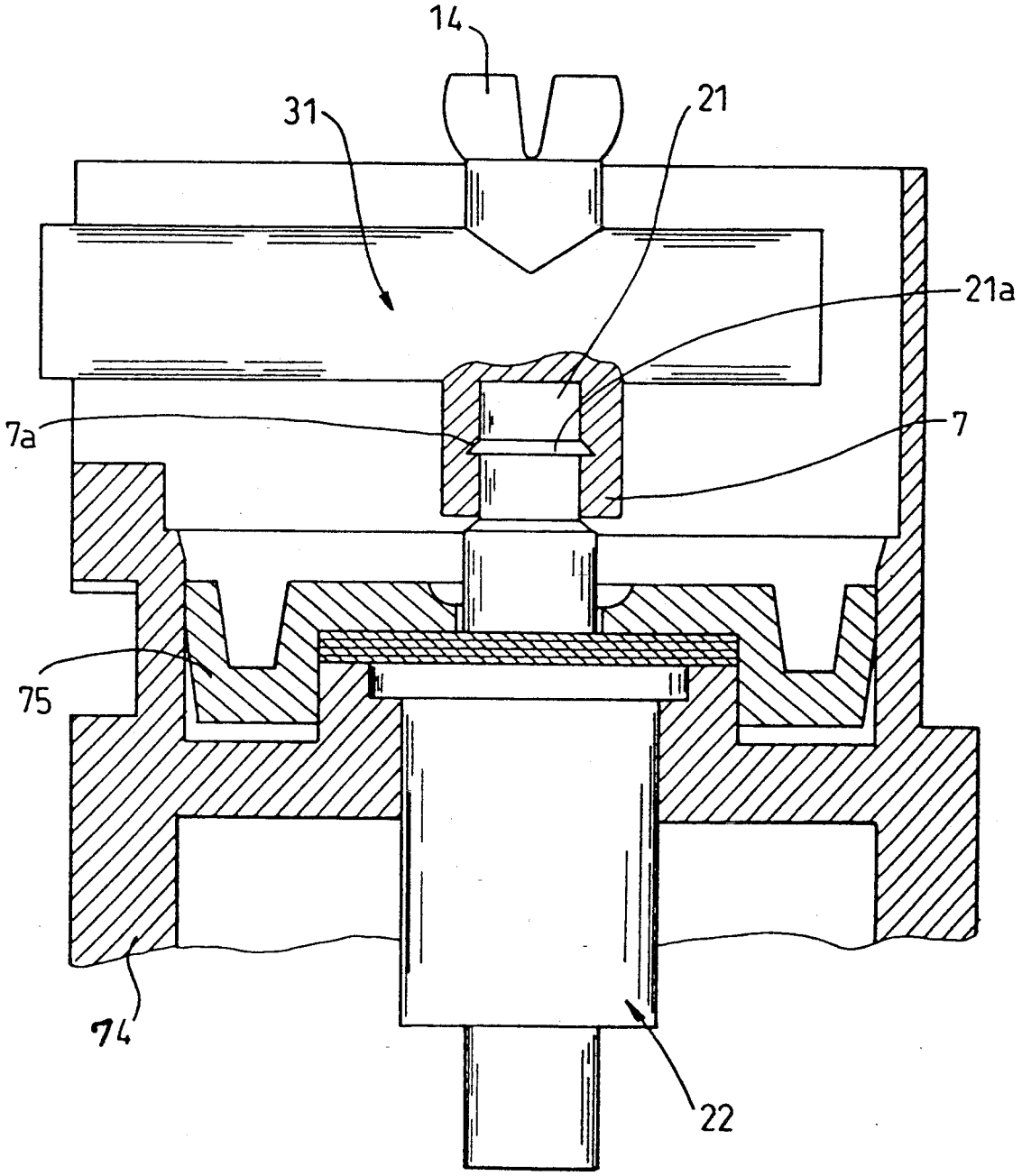
FIG. 9 is a view similar to FIG. 8 showing another variant of the invention.

FIG. 9 shows another variant of the FIG. 1 device in which the pusher 31 is secured to the push rod 21 of the pump: for example the skirt 7 of the pusher may include an annular inside groove 7*a* and the push rod 21 may include a complementary annular rib 21*a* adapted to snap into the groove 7*a*. Advantageously, the rib 21*a* has a tapering face facing away from the pump 22 and a radial face facing the pump 22. Other, equivalent, snap-fastening means could also be used, or the pusher 31 could optionally be secured to the push rod 21 by any other means. Thus, when said tank is replaced, the pusher 31 is removed from the housing together with the pump 22 and the tank 74 without there being any risk of the pusher remaining attached to the actuator rod 24.

Figure 10:
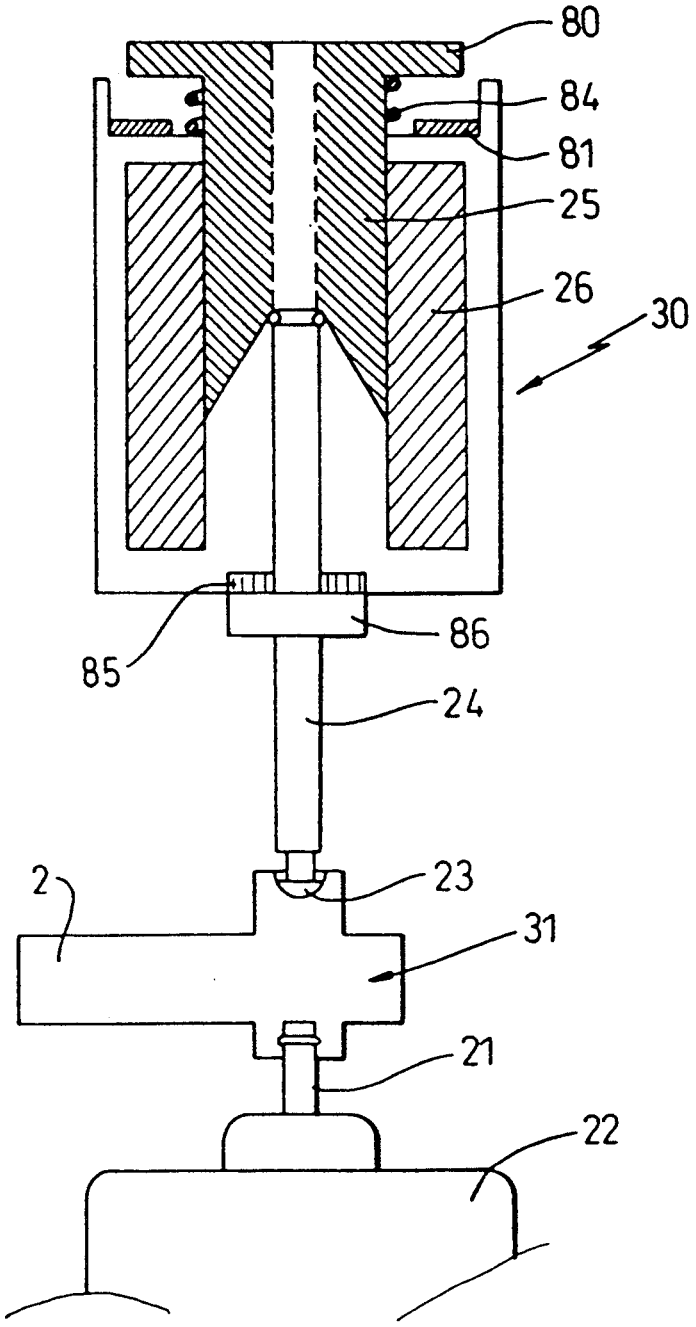
FIG. 10 is a view similar to FIG. 1 showing another embodiment of the invention.

FIG. 10 shows another embodiment of the invention in which the core 25 of the solenoid includes a return spring 84 or some other equivalent resilient means, while the pump 22 does not include a return spring. In addition, the pusher 31 is secured to the push rod 21 e.g. by snap-fastening as explained above with reference to FIG. 9. Thus, after activation followed by deactivation of the solenoid 26, the spring 84 pulls the core 25 which in turn drives the actuator rod 24, the pusher 31, and the push rod 21, thereby returning the piston means of the pump 22 to its rest position. This embodiment of the invention is particularly advantageous in that the pump 22 does not include any return spring, thus procuring the advantages mentioned above. The rest position of the moving equipment may be imposed by the pump 22, in particular by the piston coming into abutment against some other portion of the pump, or alternatively the rest position may be imposed by a flange or collar 86 on the actuator rod 24 coming into abutment against a stationary part such as a washer 85 made of shock absorbing material: while the device is at rest this avoids applying permanent traction to the snap-fastenings that interconnect firstly the pusher and the rod 24 and secondly the pusher and the push rod 21.

Figure 11:
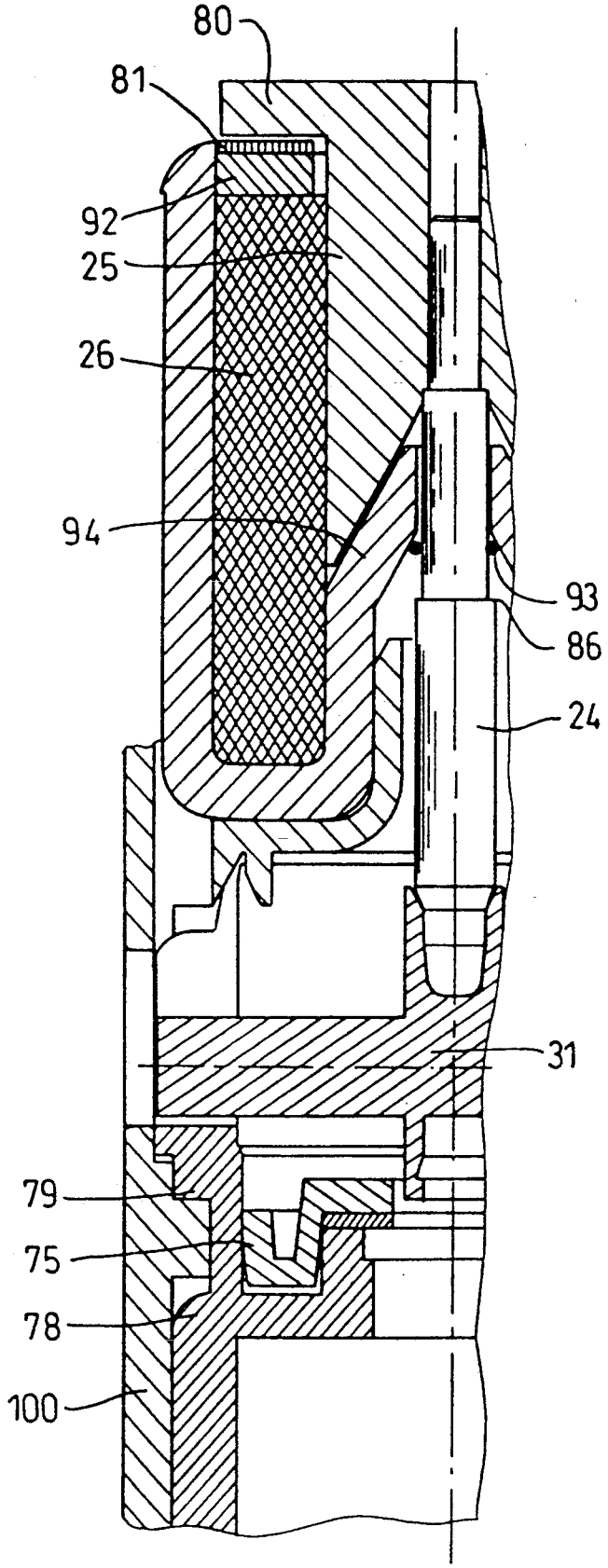
FIG. 11 is a fragmentary longitudinal section through another embodiment of the device of the invention, shown in its end-of-stroke position, and with the pump being omitted from the drawing.

The fixed item against which the flange or collar 86 comes into abutment may be of any shape. For example, as shown in FIG. 11, this item may be a stationary conical wall 94 which tapers going away from the pusher 31, together with shock absorbing means such as an O-ring 93 which is advantageously provided between the conical wall 94 and the flange or collar 86 of the rod 24. The shock absorbing means may be secured to the stationary conical wall, or to the flange 86, or it may be left free between the collar 86 and the conical wall.

The moving assembly constituted by the core 25, the rod 24, the pusher 21, the push rod, and the piston is thus dispensible between a top dead center and a bottom dead center that are predetermined by construction and that are fixed either by the piston or a moving part of the pump coming into abutment against a fixed part of the pump, or else by a moving part external to the pump (the core 25, the rod 24, etc.) coming into abutment against a stationary part. In this way, the following are determined by construction:

the lost motion of the piston when the pump has an inlet valve that is closed by relative displacement of a part that moves with the piston relative to a fixed part, said lost motion determining the distance over which the core 25 can accelerate and accumulate kinetic energy prior to compressing the fluid contained in the pump chamber; and the working stroke of the piston during which the piston compresses the fluid contained in the pump chamber, with the working stroke determining the quantity of substance that is delivered by a given pump.

Figure 12:
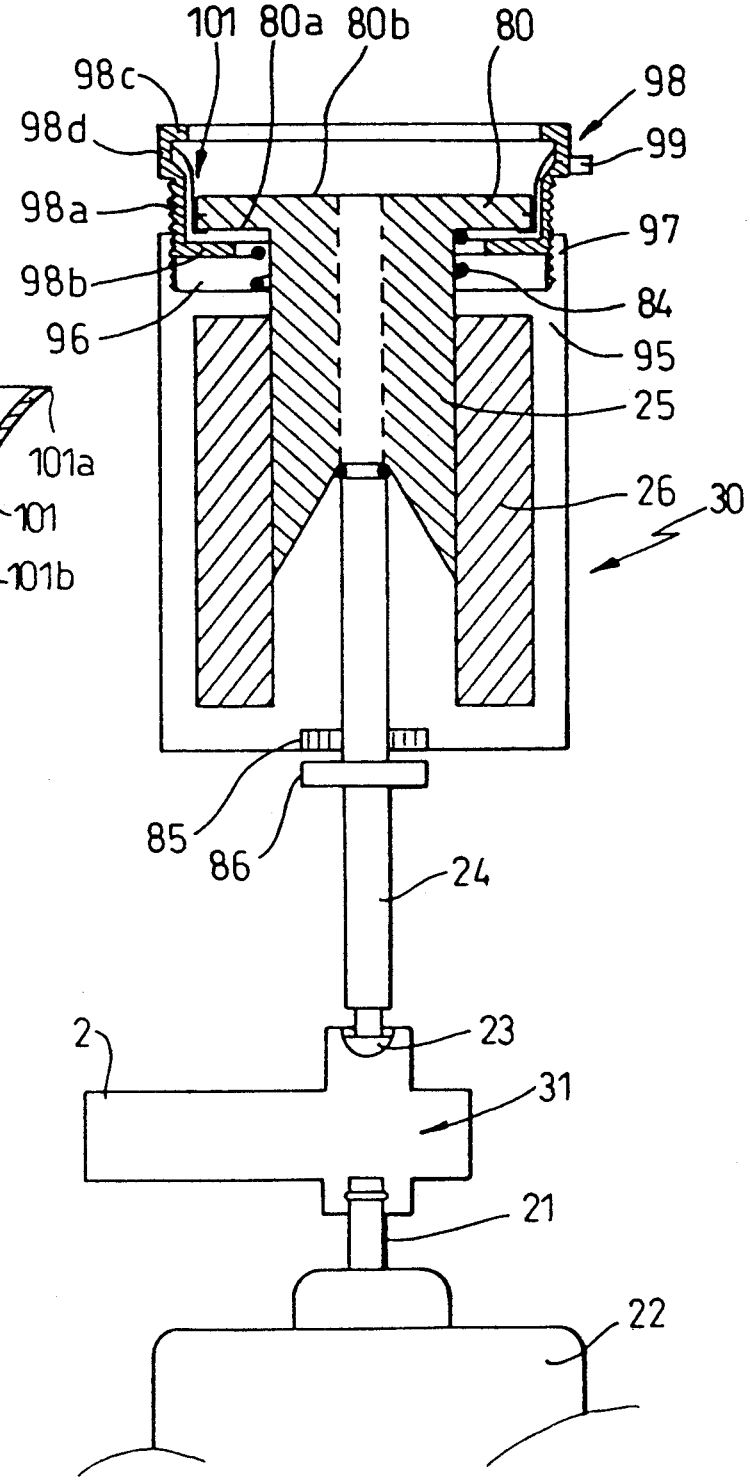
FIG. 12 is a diagrammatic view of another embodiment of the device of the invention in which the stroke of the actuator core is adjustable.
Figure 13:
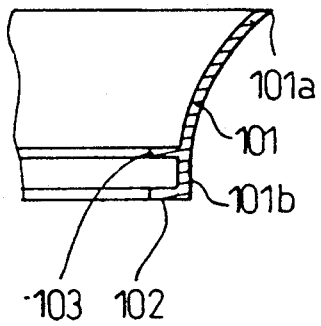
FIG. 13 shows a detail of FIG. 12.

In addition, as shown in FIGS. 12 and 13, the bottom dead center position of the moving assembly constituted by the core 25, the rod 24, the pusher 31, the push rod 21, and the piston may be adjusted by the user. This makes it possible to vary the delivery rate of the device without varying the frequency at which the core 25 is actuated, which frequency may be set to 38 Hz, for example.

In FIG. 12, the solenoid is enclosed in an enclosure 95 provided with a top basin 96 that receives the flange 80 of the core 25. The basin 96 has a side wall 97 provided with an inside screw thread and an adjusting ring 98 provided with an outside screw thread is screwed in the side wall 97. The ring 98 has a side wall **98*a* which extends between an end that is close to the solenoid and that is provided with an inside flange 98*b*, and an end that is distant from the solenoid and is provided with an inside rim 98*c*. The flange 80 of the core slides axially inside the side wall 98*a* of the rim 98, and the flange 98*b* serves as an abutment for the flange 80**, thereby fixing the bottom dead center position of the piston of the pump, and thus fixing the volume of fluid expelled by the pump each time it is actuated.

Advantageously, the ring 98 may include an index mark 99 while the wall 97 or some other stationary wall may include fluid-measurement marks, corresponding to the index mark 99.

The ring may include shock absorbing means such as the above-described washer 81 of flexible material which is interposed in this case between the flanges 81 and **98*b*. In a variant, as shown in FIG. 12, the adjustment ring 98 includes special shock absorbing means constituted by a sleeve 101 of flexible plastic material, e.g. neoprene, disposed around the flange 80 and inside the adjustment ring 98. The sleeve 101 may flare going away from the solenoid 26, in which case the adjustment ring 98 may include an enlarged portion 98*d* in the vicinity of its rim 98*c*. The sleeve 101 extends from a first end 101*a* of diameter greater than the inside diameter of the rim 98*c* on the ring and which comes into abutment against said rim, and a second end 101*b* which is fixed to the flange 80 of the core 25. The end 101*b* of the sleeve includes a first annular rib 102 which projects radially inwards against a face 80*a* of the flange 80 that faces the flange 98*b*. The sleeve 101 may be fixed to the flange 80 by any conventional means, e.g. as shown in FIGS. 12 and 13, the sleeve 101 may include a second inwardly-directed annular rib 103 which engages in a corresponding groove of the flange 80 or which may lie against the top face 80*b* of the flange 80. Thus, when the core 25 moves downwards, the rib 102 absorbs the shock between the flanges 80 and 98*b*, and when the core 25 moves upwards, the sleeve 101 is compressed against the rim 98*c*, and therefore tends to damp vibration when the moving assembly reaches its top abutment position. Because of its flexibility, the sleeve 101 adapts to different adjustments of the ring 98**.

FIGS. 16 to 18 show another variant of the device of the invention in which the dead center position of the core 25 is adjustable. In this variant, as in the variant of FIG. 11, the top dead center point of the core is set by a shoulder 86 on the rod 24 coming into abutment against a conical wall 94 secured to the solenoid 26. A washer 93 of shock absorbing material is interposed between the shoulder 86 and the wall 94, but in this case the washer is secured to the shoulder 86 by means of relief 105 on the rod 24. The relief 105 may be a resilient ring snap-fastened on the rod 24.

The bottom dead center position is set by an adjustment ring 106 which comes into abutment against the outwardly directed flange 80 of the core. A washer 81 of shock absorbing material is interposed between the adjustment ring 106 and the flange 80. The ring 106 is displaceable to rotate about the core 25, e.g. by means of a rod 107 that projects upwards and is accessible to a user.

An annular part 108 secured to the solenoid surrounds the core 25. The part 108 includes a tubular portion 109 that extends axially relative to the solenoid up to a top end face 110. The end face 110 has three identical cutouts 111 at 120° intervals from one another. Each cutout 111 is in the form of a staircase, comprising a succession of small spaced-apart dents 112.

The adjustment ring 106 includes an axial tube 113 that engages on the tube 109 and thus serves to guide the ring 106 while it rotates. The ring 106 includes three projections 114 situated inside the tube 113 and spaced apart at 120° intervals, which projections engage in the cutouts 111 of the tube 109, by bearing against the dents 112. Depending on the angular position of the adjustment ring 106, the projections 114 bear against dents that are disposed at different axial positions, thereby adjusting the height of the adjustment ring 106.

Figure 14:
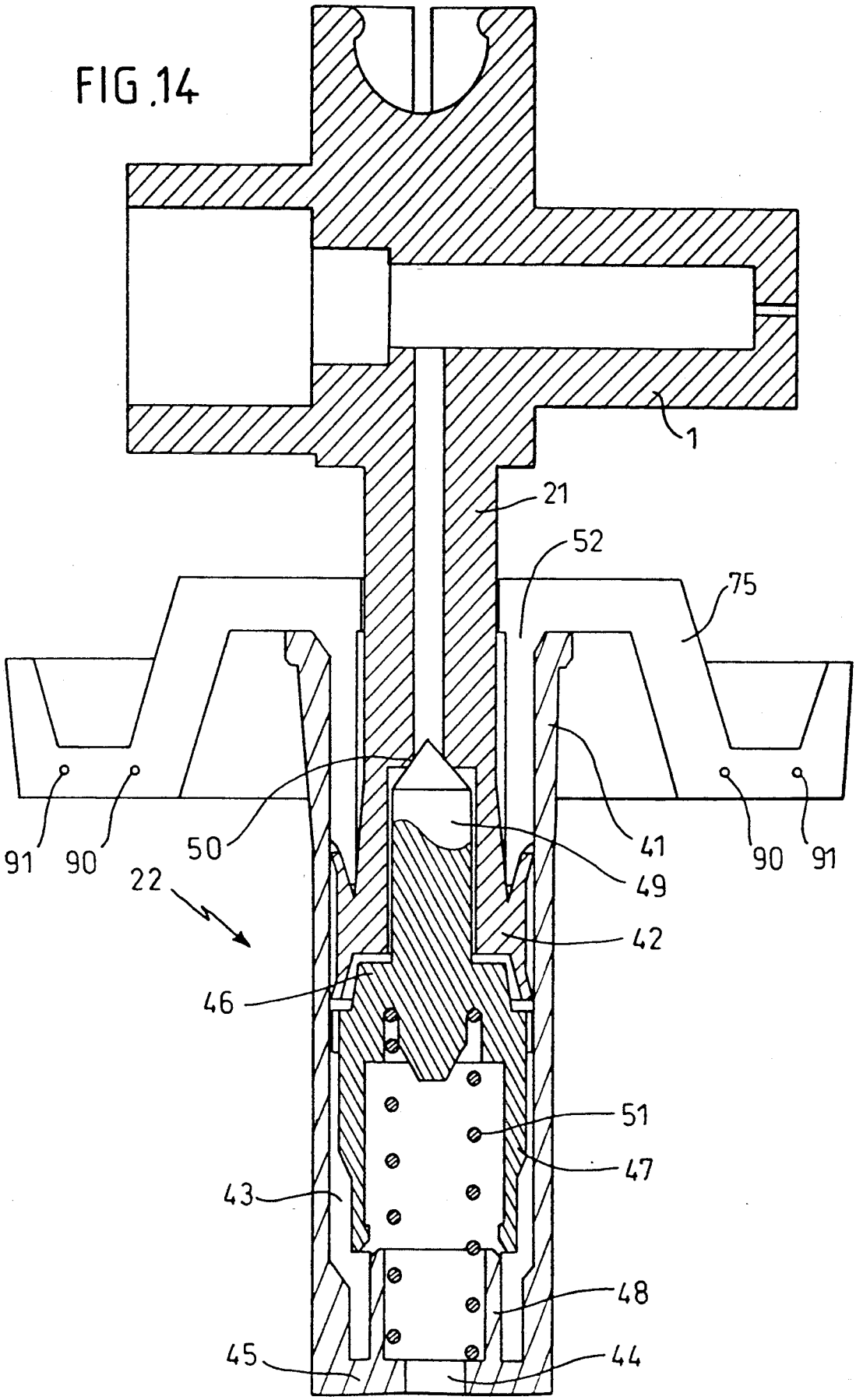
FIG. 14 is a longitudinal section view through a pump similar to that of FIG. 5, but in which a portion of the pusher is formed integrally with the piston.

Other variants of the device of the invention are possible. As shown in FIG. 14, the body 1 of the pusher may be integrally molded with the piston. With a pump as shown in FIG. 5, the sleeve 52 is then made up of two parts that are assembled around the push rod 21 before the pump is installed. As shown in FIG. 14, the sleeve 52 may be formed with the capsule 75 of FIGS. 8 and 9, which is then likewise made up of two parts that are assembled around the push rod 21. The two parts may be assembled together, for example, by interfitting or snap-fastening rods 90 in complementary holes 91 disposed in corresponding positions on the two parts.

Figure 15:
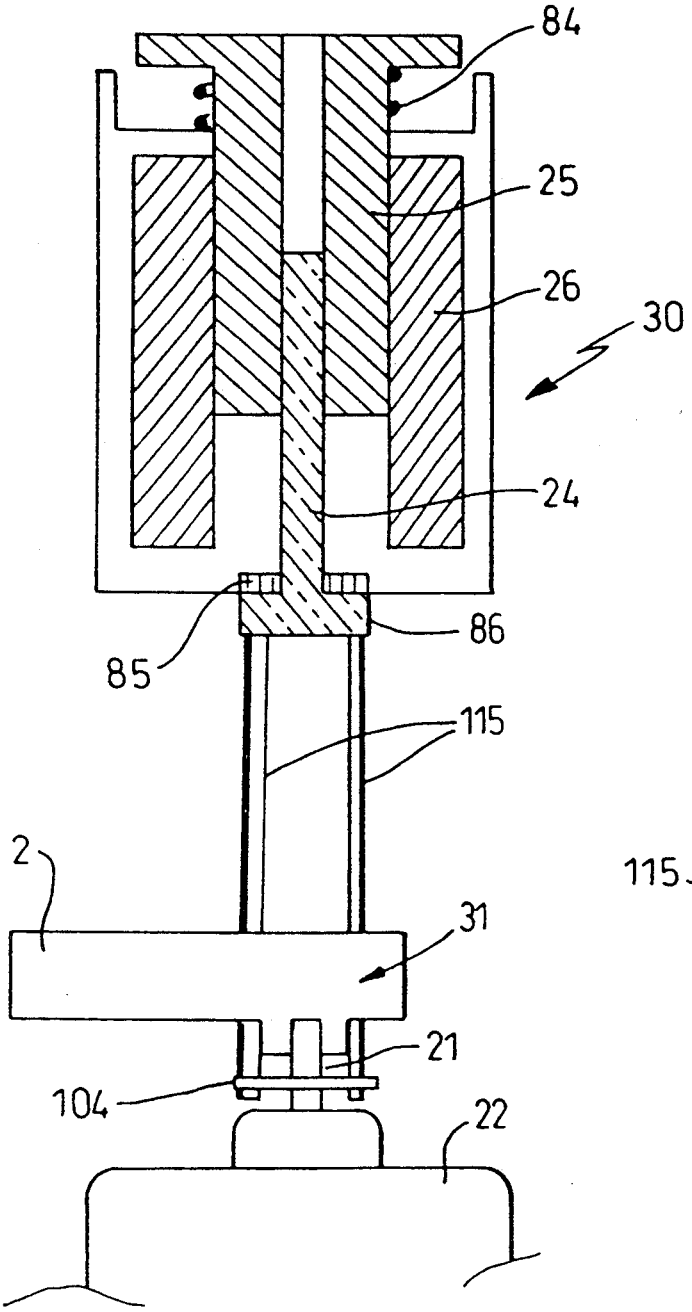
FIG. 15 is a diagrammatic view of another embodiment of the device of the invention.
Figure 15A:
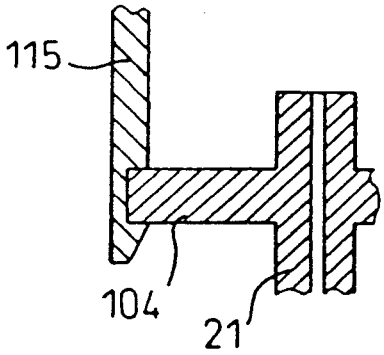
FIG. 15*a* is a section view showing a detail of FIG. 15.

FIGS. 15 and 15*a* show another variant of the device in which the rod 24 is not fixed to the pusher 31 but is fixed directly to the push rod 21 of the pump. To do this, the push rod has a flange 104 extending radially outwards and onto which resilient arms 115 secured to the rod 24 snap fasten. The arms 115 may be four in number, for example, being distributed around the periphery of the flange 104.

Figure 19:
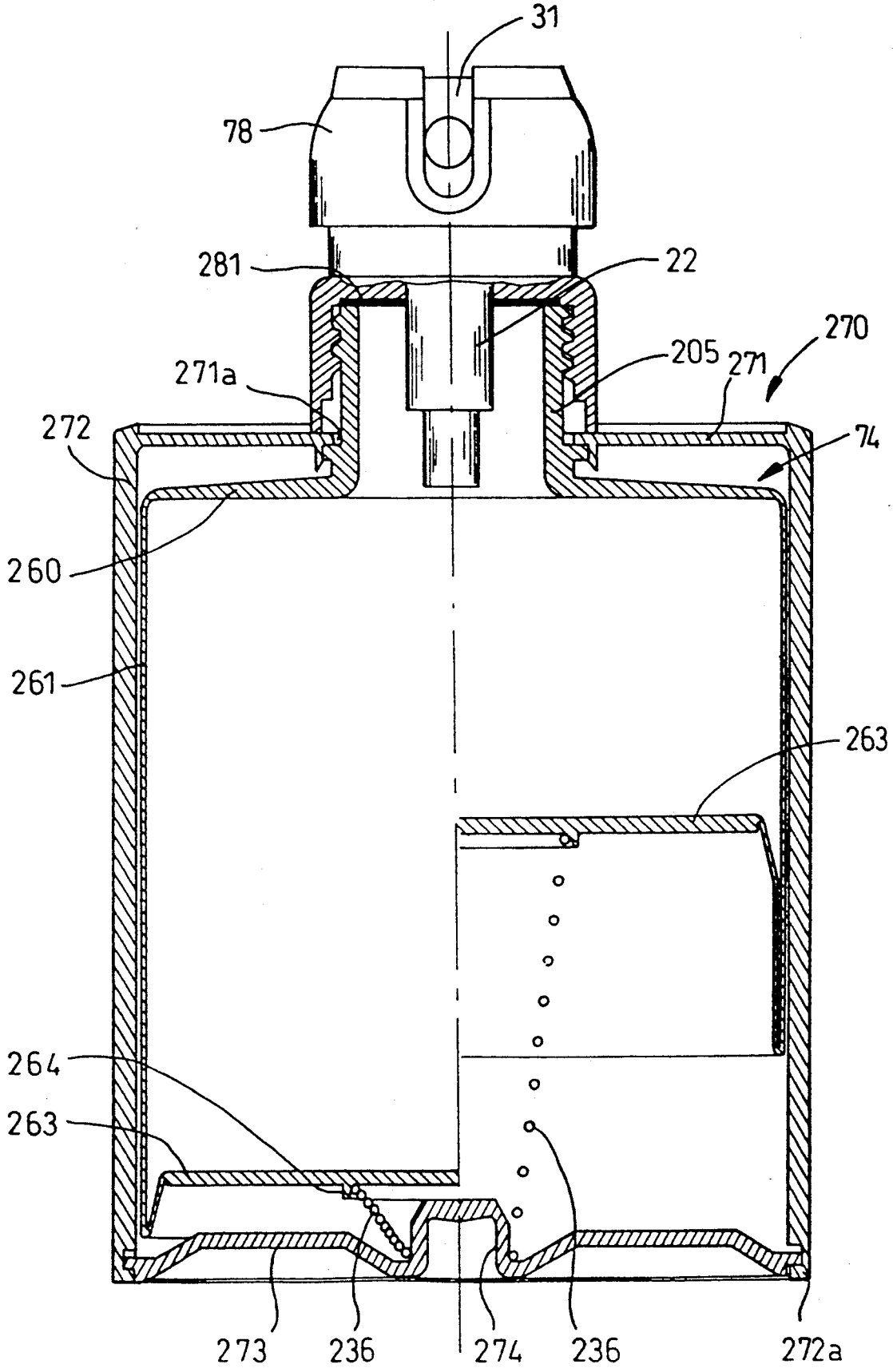
FIG. 19 is a view of a tank suitable for use in the device of the present invention, with the righthand side and the lefthand side of the figure showing the tank in two different positions.

FIG. 19 shows a deformable tank that can be used in the device of the invention, in particular when the pump 22 operates without taking in air, i.e. without allowing air to enter the tank. The tank 74 in FIGS. 8 and 9 is made of a fairly flexible material such as polyethylene. It has a neck 205 that is substantially rigid. A relatively thick and therefore rigid wall 260 extends radially outwards from the neck 205. The wall 260 extends axially downwards in the form of a cylindrical side wall 261 that is thin and therefore flexible. The side wall 261 connects to a bottom 263 that is relatively thick and therefore rigid. The bottom 263 advantageously includes an annular rib 264 on its outside face for a purpose described below. The width of the bottom 263 is slightly less than the empty space in the middle of the side wall 261.

As shown in FIG. 19, the deformable tank 74 is suitable for sliding inside a rigid sheath 270 prior to screwing together the neck 78 and the neck 205, and a flat sealing washer 81 may be interposed between the necks 78 and 205. The sheath 270 includes a top annular wall 271 pierced by a central opening 271*a* which allows the neck 205 to pass therethrough. The top wall 271 extends radially outwards to a side wall 272. The side wall 272 extends axially downwards to a bottom end 272*a*. The bottom end 272*a* is open and it may receive a bottom 273 that is screwed in place or that is removably fixed in any known way (e.g. using a quarter-turn type fixing). Between the bottom 274 of the sheath and the bottom 263 of the tank, there is a spring 236 which urges the bottom 263 of the tank upwards. In the example shown, the spring 236 is a force-fit on a central projection 274 on the bottom 273 and it is centered on the bottom 263 of the tank by an annular rib 264, however the springs 236 could be different in shape and it could be installed differently. The spring 236 could optionally be replaced by some other equivalent resilient means.

As the fluid is consumed, the bottom 263 moves up inside the side wall 261 folding it over onto itself (i.e. turning it inside out), as shown on the righthand side of FIG. 19, and this continues until the bottom 263 comes into contact with the top wall 261. The spring 263 now inside the tank 74 provides sufficient pressure to prevent some of the fluid vaporizing which would give rise to a pocket of gas that might unprime the pump. The pressure imposed by the spring 236 may be such as to ensure that the pressure throughout the tank is not less than atmospheric pressure, for example, or is possibly at least 20 kPa greater than the atmospheric pressure, thereby ensuring that a pocket of gas is not formed by the fluid contained inside the tank vaporizing, even when using solutions in alcohol. The pump 22 is therefore not in danger of being unprimed in operation by the formation of such a pocket of gas.

I claim:

1. A device for spraying or dispensing a fluid, the device comprising:

a single-acting pump (22) having a pump-body (41, 61) which defines a pump chamber (43; 73) having a capacity of less than 500 μl, that normally contains fluid to be sprayed or dispensed, and provided with a piston (42; 66) actuated by a hollow push rod (21) allowing fluid to flow therealong, said push rod extending partly outside the pump body, said piston sliding in said pump chamber to enable said fluid to be expelled when said push rod is depressed;

a pusher (31) secured to said push rod of the pump and communicating with said push rod to enable the fluid to escape, said pusher being situated outside said pump body; and a rapid repetition actuator device (30) having a solenoid (26), a core (25) sliding in said solenoid and actuated by said solenoid to move in an actuating direction, and a moving portion (24) secured to said core for actuating the push rod repetitively, by depressing said push rod when said solenoid is energized;

wherein the pusher is connected to said moving portion of the actuator device by a connection that down not leave play in the axial direction of the push rod.

2. A device according to claim 1, wherein said connections include a hinge (13, 13*a*; 14, 23).

3. A device according to claim 2, wherein said hinge is a ball-and-socket hinge.

4. A device according to claim 3, wherein said ball and socket hinge includes a ball (13) secured to the pusher and a spherical cap (13*a*) formed in the moving portion (24) and suitable for receiving said pusher ball with axial snap fastening.

5. A device according to claim 3, wherein said hinge includes a spherical socket (14) secured to the pusher and a ball (23) formed in the moving portion (24) and adapted to be engaged in said socket (14) of the pusher with axial snap fastening.

6. A device according to claim 4 or claim 5, wherein said ball (13; 23) is formed with slots (13*b*) to facilitate snap-fastening the ball in said socket (13*a*; 14).

7. A device according to claim 4 or claim 5, wherein said ball (13; 23) is formed with grooves (13*b*) to facilitate its snap-fastening in said socket (13*a*; 14).

8. A device according to claim 4 or claim 5, wherein said socket (13*a*; 14) is formed with slots (14*a*) to facilitate snap-fastening it on said ball.

9. A device according to claim 4 or claim 5, wherein said socket (13*a*; 14) is formed with grooves (14*a*) to facilitate snap-fastening it on said ball.

10. A device according to claim 1, wherein the pusher is made of plastic and said moving portion (24) of the actuator device (30) is made of metal.

11. A device according to claim 1, which the pusher (31) includes a spray nozzle (2) engaged in a cavity (9) of the pusher, and in which said spray nozzle (2B) is made up of two different-diameter cylinders, each provided with fastening means (5, 6) suitable for cooperating with fastening means (10, 11) on facing surfaces of the cavity in the pusher.

12. A device according to claim 11, wherein the spray nozzle is made up of two different-diameter portions (2A, 2B) engaged one inside the other, an outer portion (2A) projecting beyond the pusher, and an inner portion (2B) engaged in the bottom of the cavity (9) in the pusher (31) so that pressure between the two portions of the spray nozzle urges the inner portion (2B) towards the bottom of the cavity in the pusher.

13. A device according to claim 1, wherein the pump (22) includes a resilient return member (51; 70) for returning the piston (42; 66), and said resilient member also serves as return means for the actuator device (30), for returning said core (25) in a direction opposite said actuating direction.

14. A device according to claim 1, including retention means preventing the pusher from coming apart from the push rod, wherein the retention means includes resilient arms (76) disposed on either side of the pusher (31) and each including one end that is secured to the pump (22) and a free end that is provided with a catch (77) which limits the displacement of the pusher in a direction away from the pump.

15. A device according to claim 1, wherein the pump (22) does not include an internal resilient return member for the piston (42; 66), and the actuator device (30) includes its own resilient return member (84) for returning the core (25), which also serves to return the piston of the pump.

16. A device according to claim 1, wherein the pusher (31) is secured to the push rod (21) of the pump by snap-fastening.

17. A device according to claim 1, wherein said actuator device (30) including rest abutment means (85, 86; 93, 86) for limiting the stroke of the core (25) in a direction where it moves away from the pump (22).

18. A device according to claim 1, wherein said actuator device (30) includes end-of-stroke abutment means (80, 81; 80, 98) for limiting the stroke of the core (25) in an end-of-stroke position, where the core is closest to the pump.

19. A device according to claim 18, wherein said end-of-stroke abutment means are adjustable to modify the end-of-stroke position of said core (25).

20. A device according to claim 1, wherein the pump includes an inlet valve that is closed by relative displacement of two portions (47, 48; 67, 62) sliding one within the other, one of these portions (47; 67) being displaceable with the piston (42; 66) and the inlet valve closes only after the piston has travelled through a certain amount of lost motion (m).

21. A device according to claim 1, wherein the core (25) includes an outwardly-directed flange (80) and slides in a coaxial ring (98) which is adjustable in position, said ring having an inwardly-directed flange (98*b*) which limits the stroke of the flange of the core towards the pump (22), said ring also having an inwardly-directed rim (98*c*) situated on the side of the core flange (80) facing away from the pump and the ring contains a flexible shock absorbing sleeve (101) having a first end (101*a*) held against the inwardly-extending rim of the ring and a second end (101*b*) fixed to the flange of the core.

22. A device according to claim 21, wherein said second end (101*b*) of the flexible sleeve (101) includes an inwardly-directed rib disposed between the flange (80) of the core and the inwardly-directed flange (98*b*) of the ring.

23. A device according to claim 1, wherein the pump (22) operates without taking in air, the device including a deformable tank (74) having a top portion (260) in which an opening (205) for receiving the pump is formed, the tank including at least one deformable wall (261), said deformable wall being adapted to move between a first position in which the tank defines a substantially zero second position in which the tank defines a substantially zero inside volume, and it further includes resilient means (236) urging said deformable wall towards its second position with sufficient force to establish a pressure in the vicinity of the pump which is greater than the vaporization pressure of said fluid at ambient temperature, regardless of the position of said deformable wall.

24. A device according to claim 23, wherein said pressure created by said resilient means (236) is not less than atmospheric pressure.

25. A device according to claim 23, wherein said pressure creased by said resilient means (236) is at least 20 kPa greater than atmospheric pressure.

26. A device according to claim 23, wherein the deformable wall includes a rigid bottom (263) and a flexible side wall (261), said resilient means (263) urging the rigid bottom towards the pump (22), and when the volume of fluid contained in the tank (74) reduces, the bottom of the deformable wall moves towards the pump folding said flexible side wall progressively over itself.

27. A device according to claim 18 or 21, wherein the tank is placed in a rigid sheath (272) whose shape is substantially complementary to the side wall (261) of said tank.

* * * * *